US010323361B1

(12) United States Patent
Karmie et al.

(10) Patent No.: US 10,323,361 B1
(45) Date of Patent: Jun. 18, 2019

(54) SYNTHETIC TURF SYSTEM MADE WITH ANTISTATIC YARNS AND METHOD OF MAKING

(76) Inventors: Dale Karmie, Uniontown, OH (US); Brian Karmie, Uniontown, OH (US); Ty Allen, Uniontown, OH (US); Davis Lee, Kennesaw, GA (US)

( * ) Notice: Subject to any disclaimer, the term of this patent is extended or adjusted under 35 U.S.C. 154(b) by 178 days.

(21) Appl. No.: 13/534,992

(22) Filed: Jun. 27, 2012

Related U.S. Application Data

(60) Provisional application No. 61/501,722, filed on Jun. 27, 2011, provisional application No. 61/506,951, filed on Jun. 12, 2011.

(51) Int. Cl.
*E01C 13/08* (2006.01)
*D05C 17/02* (2006.01)
*D06N 7/00* (2006.01)

(52) U.S. Cl.
CPC ..... *E01C 13/08* (2013.01); *D05C 17/02* (2013.01); *D06N 7/0065* (2013.01);
(Continued)

(58) Field of Classification Search
CPC . E01C 13/08; D10B 2505/202; Y10S 273/13; D06N 7/0068; D06N 2201/10;
(Continued)

(56) References Cited

U.S. PATENT DOCUMENTS 2,328,600 A 9/1943 Baggett
3,803,453 A 4/1974 Hull
(Continued)

FOREIGN PATENT DOCUMENTS

CN 102535308 A * 7/2012
CN 204097830 U * 1/2015
(Continued)

OTHER PUBLICATIONS

Product information on Nega-Stat, Static Dissipative Yarns, by William Barnet & Son, LLC, printed from website nega-stat.com on Feb. 22, 2015.*
(Continued)

*Primary Examiner* — Cheryl Juska

(74) *Attorney, Agent, or Firm* — Smith Tempel; Steven P. Wigmore

(57) ABSTRACT

A synthetic turf system and method includes turf tufted from monofilament fibers of a thermoplastic polymer where about 1 in about 32 tuft rows comprise at least one antistatic filament per tuft. Each antistatic filament has a first nonconductive polymeric component coextensive with a second non-conductive component. One or more of the antistatic filaments substantially reduces static electrical discharge within the turf. The thermoplastic polymer for each fiber may comprise at least one of nylon, polyethylene, polypropylene, and polyester. Each tuft of the tufted turf may be twisted and each tuft may be slit to form multiple ends. The turf system may comprise stitched turf. Each antistatic filament may comprise a carbon core surrounded by a non-conductive sheath, wherein a ratio of the antistatic filament per number of tuft rows may comprise at least one of 1:2, 1:4, 1:8, and 1:16.

9 Claims, 10 Drawing Sheets

FIG. 4B

(52) U.S. Cl.
CPC ... *D06N 7/0068* (2013.01); *D06N 2201/0254* (2013.01); *D06N 2201/0263* (2013.01); *D06N 2201/10* (2013.01); *D06N 2209/041* (2013.01); *D06N 2209/046* (2013.01); *D10B 2505/202* (2013.01); *Y10T 428/23921* (2015.04); *Y10T 428/23936* (2015.04); *Y10T 428/23957* (2015.04); *Y10T 428/23993* (2015.04)

(58) Field of Classification Search
CPC ..... D06N 7/0065; D06N 2209/046; D06N 2209/04; D06N 2209/041; D05C 17/02; Y10T 428/23921; Y10T 428/23936; Y10T 428/23957; Y10T 428/23993
USPC ..... 428/17, 97, 87
See application file for complete search history.

(56) References Cited

U.S. PATENT DOCUMENTS

| | | | | |
|---|---|---|---|---|
| 3,849,242 | A | | 11/1974 | Takeya et al. |
| 3,969,559 | A | | 7/1976 | Boe |
| 3,971,202 | A | | 7/1976 | Windley |
| 4,154,881 | A | | 5/1979 | Handa Junzo et al. |
| 4,216,264 | A | | 8/1980 | Naruse et al. |
| 4,309,479 | A | | 1/1982 | Naruse et al. |
| 4,337,283 | A | | 6/1982 | Haas, Jr. |
| 4,356,220 | A | * | 10/1982 | Benedyk ..... 428/17 |
| 4,420,534 | A | | 12/1983 | Matsui et al. |
| 4,612,150 | A | | 9/1986 | De Howitt |
| 4,672,005 | A | | 6/1987 | Dyer |
| 4,743,505 | A | | 5/1988 | Yamada et al. |
| 4,921,890 | A | | 5/1990 | Hayashi |
| 4,997,712 | A | | 3/1991 | Lin |
| 5,116,681 | A | | 5/1992 | Lin |
| 5,147,704 | A | | 9/1992 | Lin |
| 5,202,185 | A | | 4/1993 | Samuelson |
| 5,260,013 | A | | 11/1993 | Samuelson |
| 5,525,261 | A | | 6/1996 | Incorvia et al. |
| 5,679,449 | A | | 10/1997 | Ebadat et al. |
| 5,698,148 | A | | 12/1997 | Asher |
| 5,776,608 | A | | 7/1998 | Asher |
| 6,207,592 | B1 | | 3/2001 | Nickell |
| 6,381,482 | B1 | | 4/2002 | Jayaraman et al. |
| 6,552,131 | B1 | | 4/2003 | Higuchi et al. |
| 6,620,482 | B2 | | 9/2003 | Carr et al. |
| 6,794,007 | B2 | | 9/2004 | Carr et al. |
| 7,198,427 | B2 | | 4/2007 | Carr et al. |
| 7,754,308 | B2 | | 7/2010 | Koch et al. |
| 8,288,470 | B2 | | 10/2012 | Ansems et al. |
| 8,450,430 | B2 | | 5/2013 | Silvis et al. |
| 8,568,852 | B2 | * | 10/2013 | Smit et al. ..... 428/87 |
| 2003/0186608 | A1 | * | 10/2003 | Goldberg ..... 442/304 |
| 2008/0090955 | A1 | | 4/2008 | Lambert et al. |
| 2010/0040808 | A1 | * | 2/2010 | Van Der Gaag et al. ..... 428/17 |

FOREIGN PATENT DOCUMENTS

| | | | | |
|---|---|---|---|---|
| JP | 51046777 | B | * | 12/1976 |
| JP | 85057381 | B | * | 12/1985 |
| JP | 88049003 | B | * | 10/1988 |
| JP | 03039507 | A | * | 2/1991 |
| JP | 06220812 | A | * | 8/1994 |
| JP | 08308712 | A | * | 11/1996 |
| KR | 1387599 | B1 | * | 4/2014 |

OTHER PUBLICATIONS

Machine translation of JP 06-220812 A, Tanaka et al., 1994.*
Nega-Stat(R) Brand Static Dissipative Yarn advertisement, two pages, accessed in Jun. 2011, from www.barnet.com.
Assignment Record for Nega-Stat(R) brand fiber U.S. Pat. No. 5,202,185, Transfer From E. I. Dupont De Nemours and Company to William Barnet & Son LLC of Arcadia, South Carolina as recorded on Mar. 31, 2003 in the USPTO.

* cited by examiner

Needle Set Up (40 out of 480 needles)
33
Antistat in every needle (1/1)

33
Antistat in every 2nd needle (1/2)

33
Antistat in every 4th needle (1/4)

33
Antistat in every 8th needle (1/8)

33
Antistat in every 16th needle (1/16)

SYNTHETIC TURF SYSTEM MADE WITH ANTISTATIC YARNS AND METHOD OF MAKING

PRIORITY CLAIM AND RELATED APPLICATIONS STATEMENT

Priority under 35 U.S.C. § 119(e) is claimed to U.S. provisional application entitled "SYNTHETIC TURF SYSTEM MADE WITH ANTISTATIC YARNS AND METHOD OF MAKING," filed on Jun. 27, 2011 and assigned U.S. provisional application Ser. No. 61/501,722; and to U.S. provisional application entitled "SYNTHETIC TURF SYSTEM MADE WITH ANTI STATIC YARNS AND METHOD OF MAKING," filed on Jul. 12, 2011 and assigned U.S. provisional application Ser. No. 61/506,951. The entire contents of this provisional patent application are hereby incorporated by reference.

BACKGROUND

Synthetic turf sometimes has an undesirable tendency to build up static charge in itself as well as the persons who walk or play on it. This may cause static electrical shocks to the body. Surprisingly, static charge build up is known to occur even in high humidity environments such as found in regions like Florida during the summer months.

Static charge is particularly problematic on playgrounds where playground equipment is often constructed of insulating materials that also have a propensity to build up static charge. Synthetic turf can act as insulator so that even when a static charge is created on a piece of playground equipment such as a slide it is not dissipated as a person walks across the turf until a conductive ground, such as a metal pole, is touched.

Conventional ways to solve the static problem in synthetic turf have not worked. For instance Brunswick Corporation U.S. Pat. No. 4,356,220 describes an artificial grass product comprising: a pile fabric with yarn comprised of a plurality of fibers made of a polymeric material. This patent teaches that additives, such as antistatic agents, can be dispersed in the fibers.

Meanwhile, U.S. Pat. No. 4,672,005 issued in the name of Dyer describes a process for improving the hygroscopic and soil release properties of a polymer substrate in which the substrate is contacted with a suitable aqueous mixture containing a water soluble vinyl monomer and a hydrophobic vinyl monomer. This patent alleges that antistatic properties with this process are improved.

Antistatic polymer additives have been used to solve this problem but have been found to be ineffective because they may cause a deterioration of fiber extrusion performance and fiber physical properties. In addition, static dissipation of the turf is inadequate to render a noticeable benefit.

Antistatic topical additives such as glyceryl monostearate or octadecylbis (2-hydroxyethyl) amine, sold under the tradenames Armostat™ 1000 beads, and Armostat™ by Akzo Nobel Polymer Chemicals B.V. of the Netherlands which may be applied to fiber during manufacture have also been used. But these have also been found to be ineffective as they are not substantive solutions for outdoor environments, especially in the presence of rain.

Other ways of solving this problem have been the topical application of antistatic chemicals, such as Staticide™ sold by Amstat Industries of Glenview, Ill., directly to the synthetic turf. While effective in some situations, this solution is limited since topically applied chemicals are not substantive solutions for outdoor environments, especially in the presence of rain.

Meanwhile, the problem of static shock has been addressed in carpet by incorporating an electrically conductive fiber into pile yarn used to make the carpet. U.S. Pat. No. 3,971,202 issued in the name of Windley for instance describes cobulking electrically conductive sheath-core filaments such as those disclosed in U.S. Pat. No. 3,803,453 issued in the name of Hull with nonconductive filaments to form a crimped, bulky carpet yarn. This carpet yarn may dissipate static electricity charges which are annoying to people who walk on nonconductive carpets when humidity is low. In this instance the, conductive filaments are tangled with the carpet tufts so that they extend the full length of the carpet tuft.

U.S. Pat. No. 4,612,150 issued in the name of De Howitt describes introducing spin-oriented electrically conductive bicomponent filaments into a quench chimney wherein nonconductive filaments are melt spun and cooled, combining the conductive and nonconductive filaments at a puller roll, drawing and cobulking the combined yarn and then winding up the yarn.

These conventional approaches are problematic with synthetic turf since it is not practically possible to cobulk electrically conductive filaments with nonconductive filaments. This is because turf fibers are typically monofilament or slit tape. Because synthetic turf fibers are large, it is not possible to combine the antistatic yarn with synthetic turf fiber in such a way that the two yarns are intimately entangled as is characteristically done in carpet.

Another problem in the art which is unique to synthetic turf is the use of infill. Synthetic turf incorporates the use of infill. This is a particulate material that is incorporated onto the turf face between tufts. The purpose of infill is to hold tufts upright and to provide a cushion on which to play. These materials are typically all insulators and thus exacerbate static electricity as understood by one of ordinary skill in the art.

SUMMARY

A synthetic turf system and method includes turf tufted from monofilament fibers of a thermoplastic polymer where about 1 in about 32 tuft rows comprise at least one antistat filament per tuft. Each antistat filament has a nonconductive polymeric component coextensive with a component of an electrically conductive material dispersed in a polymeric matrix. One or more of the antistat filaments substantially reduces static electrical discharge within the turf. The thermoplastic polymer for each fiber may comprise at least one of nylon, polyethylene, polypropylene, and polyester. Each tuft of the tufted turf may be twisted and each tuft may be slit to form multiple ends. The turf system may comprise stitched turf. Each antistat filament may comprise a carbon sheath and a ratio of the antistat filament per number of tuft rows may comprise at least one of 1:2, 1:4, 1:8, and 1:16.

Specifically, according to one exemplary embodiment, an improved durable antistatic synthetic turf includes combining an antistatic fiber such as with a monofilament polyethylene or a slit tape polyethylene by twisting the two yarns together into combined yarns. The twisted yarn is then tufted so as to place at least one antistat filament combination in about each 32 rows of tufted rows. This means that for every 31 tufts of standard yarn (no antistat filament) there is one tuft having standard yarn combined with an antistat filament. Similarly, in other exemplary embodiments, at least one antistat filament combination may be provided in about every second row, or every fourth row, or every eighth row, or every sixteenth row, as set forth in Appendix A.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In the Figures, like reference numerals refer to like parts throughout the various views unless otherwise indicated. For reference numerals with letter character designations such as "100A" or "100B", the letter character designations may differentiate two like parts or elements present in the same figure. Letter character designations for reference numerals may be omitted when it is intended that a reference numeral to encompass all parts having the same reference numeral in all figures.

DETAILED DESCRIPTION

The word "exemplary" is used herein to mean "serving as an example, instance, or illustration." Any aspect described herein as "exemplary" is not necessarily to be construed as exclusive, preferred or advantageous over other aspects.

Figure 1:
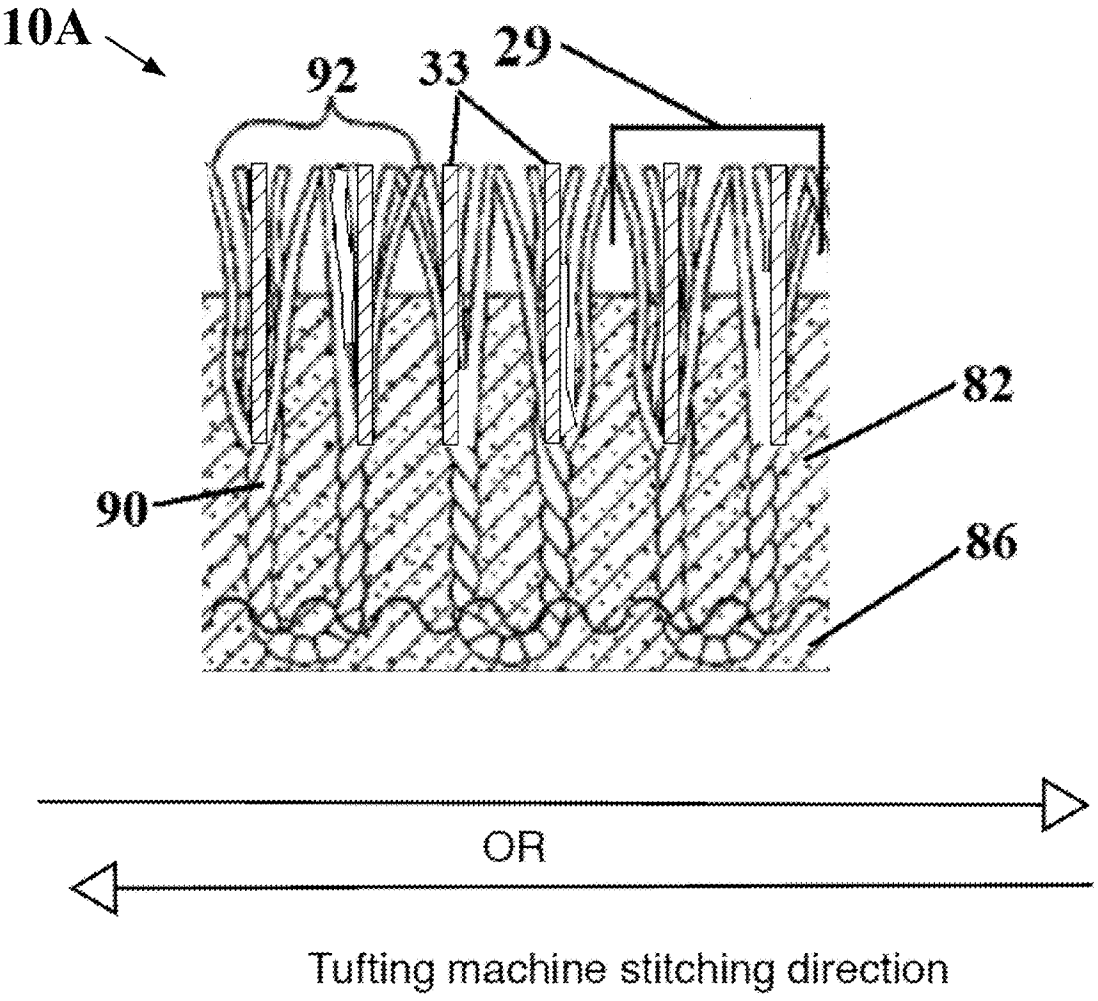
FIG. 1 is side view of one exemplary embodiment of a turf system in which yarn is in a twisted form when it is tufted through a fabric backing.

Referring now to the figures, FIG. 1 is side view of one exemplary embodiment of a turf system 10A in which yarn 90 is in a twisted form when it is tufted through a fabric backing 86. Each tuft of yarn 90 may form two bundles 29 of grass blade ends 92 containing an antistat filament 33 in which the bundles 29 are surrounded by an infill layer 82 The antistat filament 33 has been illustrated with a parallel line hatching. The antistat filament 33 may comprise conductive materials, such as, but not limited to, a core made from carbon.

Specifically, the antistat filament 33 may comprise a non-conductive outer sheath or layer that encapsulates a central core, which may also be made from a conductive material, such as carbon. The antistat filament 33 has a nonconductive polymeric component coextensive with a component of carbon dispersed in a polymeric matrix. It has been discovered that the antistat filament 33 may substantially reduce and in some situations, eliminate, static electrical discharges within the turf system 10.

In FIG. 1, each tuft or twisted yarn 90 is shown with two ends having an antistat filament 33. One of ordinary skill in the art recognizes that these two antistat filaments 33 illustrated for each tuft or twisted yarn 90 is the same, single antistat filament 33. That is, only one antistat filament 33 is used in each yarn 90 that is illustrated in FIG. 1. The single antistat filament 33 was not shown present along the entire length of each twisted yarn 90 for brevity. Further details about the antistat filament 33 and infill layer 82 will be described below in connection with other exemplary embodiments of the turf system 10.

FIG. 1 also illustrates the tufting machine stitching direction with arrows which run parallel to the length dimension of the fabric backing 86 (FIG. 1 shows the length and height dimensions of one exemplary embodiment of the turf system 10A). As illustrated in FIG. 1, the individual monofilaments, fibrillated or slit filaments with grass blade ends 92 are twisted together near the stitched end and come apart at the top. The preferred turf system 10A includes a twisted fiber of yarn 90.

FIG. 1 illustrates an improved durable antistatic synthetic turf system 10 which includes combining an antistat filament 33 such as with a monofilament polyethylene or a slit tape polyethylene by twisting the two structures together by placing about 0.25 to about 2.0 twists per inch (TPI) of twist into the combined structure.

The twisted yarn is then tufted so as to place at least one antistat filament combination (tuft with standard yarn and antistat filament 33) in about every 32 rows of tufted rows. This means that for every 31 tufts of standard yarn (no antistat filament 33) there is one tuft having standard yarn combined with an antistat filament 33. Similarly, in other exemplary embodiments, at least one antistat filament combination may be provided in about every second row, or every fourth row, or every eighth row, or every sixteenth row, as set forth in the test data section listed below. Meanwhile, FIG. 1 (as well as FIG. 2) illustrates an antistat filament 33 present in every tuft row (1:1 ratio).

The turf system 10A may have many types of applications. It may be used for both commercial and residential landscapes. The turf system 10A may also be used for an athletic field and for playgrounds.

Figure 2:
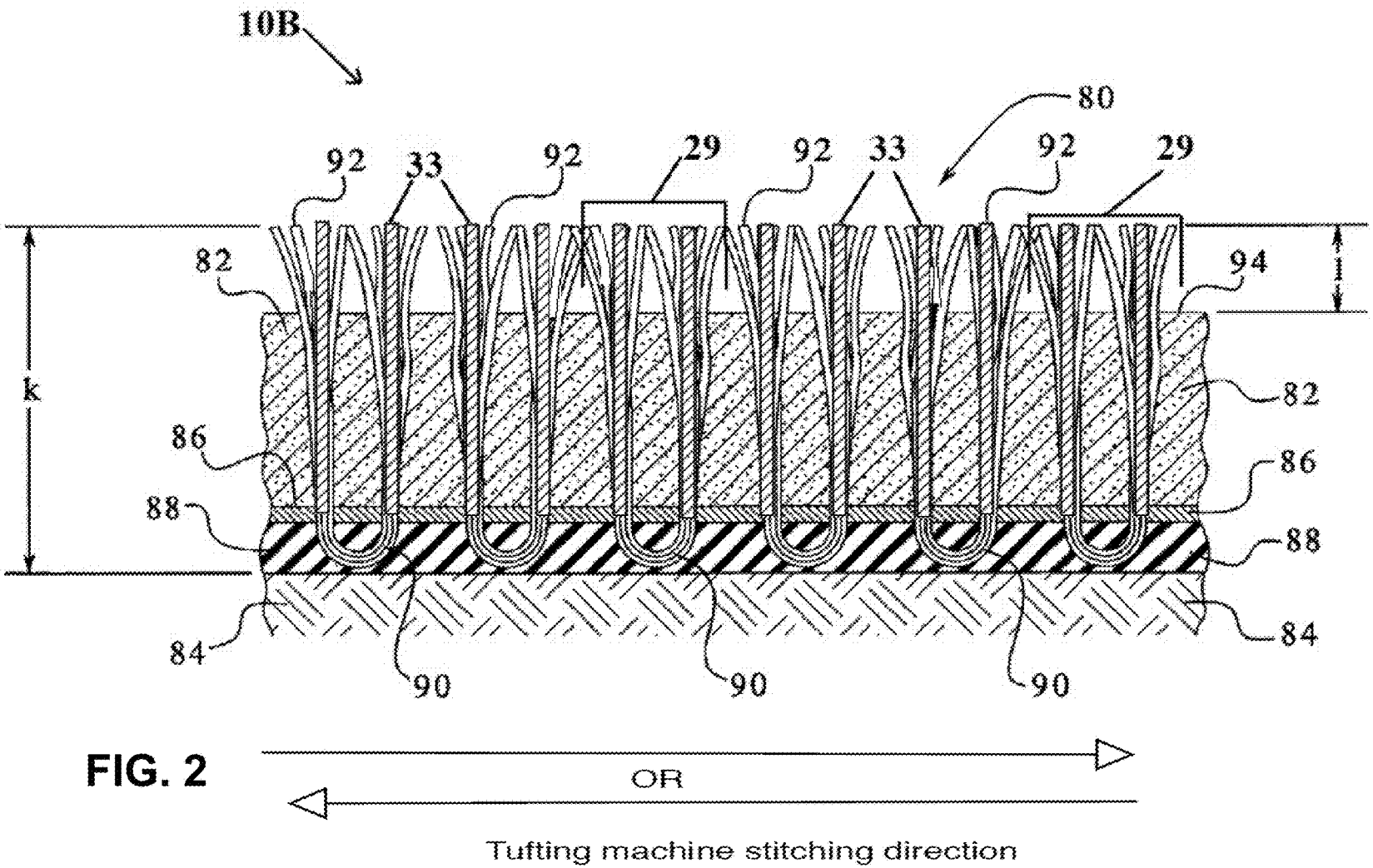
FIG. 2 is a side view of an exemplary embodiment of a sports turf system which includes a base that establishes the contour of a playing surface.

Referring now to FIG. 2, a sports turf system 10B is illustrated which includes a base 84 that establishes the contour of a playing surface. The base 84 may comprise compacted crushed stone, concrete or asphalt pavement or compacted clay and gravel rolled into ordinary dirt. Although not shown, a slight slope or grade in the base 84 is preferable to facilitate surface water drainage.

The synthetic surface of the system 10B, as shown in FIG. 2, has a thin, flexible, fabric backing 86 with parallel rows of vertical grass blade ends 92 projecting upwardly from the fabric backing 86. A relatively thick layer 82 of infilled particulate material is provided on the backing 86 supporting the grass blade ends 92 in a relatively upright position on the fabric backing 86.

The grass-like yarns 90 with ends 92 may comprise a monofilament fiber or slit tape fiber. Strands of yarn 90 may comprise from about 3.0 to about 50.0 or more individual filaments. The yarn 90 may be combined with an antistat filament 33 which will be described in further detail below. Similar to FIG. 1, the antistat filament 33 has been illustrated with a parallel line hatching. As will be described below, the antistat filament 33 may comprise a non-conductive outer sheath or layer that encapsulates a conductive central core, made from carbon.

Each yarn 90 may be made from, e.g., about 1/16 inch (which is about 0.16 cm) wide polyethylene monofilament and having a thickness of about five mils. This yarn 90 may be slit and twisted to form a plurality of thin filaments or grass blade ends 92, is tufted or stitched through the fabric backing 86. The exemplary embodiment illustrated in FIG. 2 does not show the yarn 90 to be twisted.

The yarn 90 may comprise a thermoplastic polymer, such as a polyethylene monofilament described above. In other exemplary embodiments, the thermoplastic polymer may comprise at least one of nylon, polypropylene, and polyester.

If the yarn 90 is fibrillated, the thin filaments forming the grass blade ends 92 remain connected at certain points so that the yarn 90 when stretched apart creates a honeycombed mesh. Strands of yarn 90 can comprise from about three to about fifty or more individual filaments with the grass blade ends 92. The individual grass blade ends 92 may stack one on top of the other.

Typical tufts or stitches include about four to about twelve yarns 90 per inch (2.5 cm) that may be used with conventional carpet tufting or stitching machines. The height of the yarn 90 with ends 92 (i.e., grass blades) can vary but are typically between about 1.0 inch to about 2⅝ inches (about 2.5 to about 6.7 cm) high. The machines typically produce rows of tufts that are commonly about ⅜ inch to about ¾ inch (about 0.93 to about 1.87 cm) apart.

Tufting, stitching. knitting or weaving different types of yarns into a standard carpet by threading different yarns into a plurality of laterally aligned needles is understood by one of ordinary skill in the art. The underside of the fabric backing 86 can be coated with a resinous coating 88 that secures the tufts in place. The coating 88 usually increases the dimensional stability of the fabric backing 86 as well as the moisture resistance of the fabric backing 86.

A preferred manner of coating the fabric backing 86 is to contact the back of the fabric backing 86 with a solution of polyurethane polymer and then subject the fabric backing 86 to a heat treatment to cure the polyurethane polymer coating. Conventional polyvinyl chloride, polyvinyl acetate or natural or synthetic rubber latex coatings may also be employed.

In sports applications, after laying and adhering the synthetic turf 80 to the base 84, turf installers typically infill or infuse a layer 82 of compacted material having a mixture of resilient particles and fine sand between the synthetic grass blades. Turf installers have been known to use a variety of different resilient materials, such as, but not limited to: (i) granulated cork; (ii) rubber particles including natural rubber or synthetic rubber; (iii) beads of synthetic polymers such as vinyl chloride, vinyl ethers, vinyl acetate, acrylates and methacrylates, polyvinylidene chloride, urethanes, polyamids and polyesters; (iv) synthetic polymer foam particles; (v) vinyl foams such as polyvinyl chloride foams, polyvinyl ether foams, foamed polystryene, foamed polyurethanes and foamed polyesters; and (vi) foamed natural rubber. For example, rubber such as Ethylene Propylene Diene Monomer (EPDM) and ground tire rubber may be used, while plastics such as like Thermoplastic Elastomers (TPE) may also be used for the infill layer 82.

Turf installers also at times add fine sand to the infill to fill the interstices between the resilient particles to thereby form a more densely compacted infill layer 82. In sports applications, the sand is generally smaller in size than 30 U.S. screen mesh size and is preferably between about 40 and 200 U.S. screen mesh size. Fine sand also feels less abrasive to players when they contact the turf 80.

In typical sports applications, the turf installer provides an infill layer 82 from about fifty percent of the height of the grass blade ends 92 to substantially even with the top of the grass blade ends 92. In sports applications, turf installers typically prefer a projection of a synthetic blade between ⅛ inch and ⅜ inch (0.31 and 0.93 cm) above the infill layer. Turf installers maintain an infill layer 82 substantially to the top of the grass blade ends 92 to prevent a playing surface from having a noticeable grain. Normally, the grass blade ends 92 have a characteristic grain (i.e., a tendency to lay in a given direction related to the direction in which the material passed through the production machinery). The infill layer 82 counteracts this tendency and prevents the playing surface from having an easily noticeable grain.

A relatively high infill layer 82 having a top surface 94 that includes resilient materials also absorbs much of the shock of an object impacting the playing surface and improves the footing of a player running or walking across the surface, particularly when making cuts or sharp turns. The non-abrasive character of the infill 82 and the controlled and diminished synthetic blade height projecting above the infill 82 make a playing surface much less likely to produce rug burns or abrasions when players contact the surface.

The infill layer 82 preferably is a usually a material that characteristically or inherently retards plant and animal life, absorbs water and enables it to drain through to the fabric backing 86 and the secondary backing 88 and provides a firm and stable foundation for the yarns 90. The infill layer 82 includes any material having these characteristics including, but not limited to: rock, sand, concrete, plastic, fiberglass, rubber, ceramic material, cork, or any combination or derivative thereof.

The infill layer 82 is may preferably comprise crushed rock or sand, and most preferably, it may comprise washed sand. In certain instances, e.g., in the rainy Northwest, the infill layer includes being ¼ inch (0.62 cm) minus crushed rock (i.e., ¼ inch (0.62 cm)) average diameter rock down to rock particles) to enhance drainage.

As noted above, in sport applications, the sand is preferably fine sand between about 40 and about 200 U.S. screen mesh size to feel less abrasive to players who contact the turf. The size of the sand in the infill 82 preferably includes bigger sand particles that vary between about 4 and about 70 U.S. screen mesh size. The sand is preferably in a range of sizes, which facilitates better compaction.

The preferred turf 80 includes a compacted infill layer 82 of variable sand particles. A four-ton double drum roller may be used to make one or more passes over the preferred turf 80. The length L, which is the average distance between the tips of the grass blade ends 92 and a top surface 94 of the infill layer 82, is preferably about ⅛ to about 5.00 inches (about 0.31 to about 12.50 cm) given that the contemplated variable turf height of the grass blade ends 92, k, above the primary backing 86 includes being about ½ inch to about 6.00 inches (about 1.25 to about 15 cm).

The turf having the grass blade ends 92 may project between about 0.5 inch to about 2.0 inches above the infill surface 94, wherein the free ends of the grass blade ends 92 may shield the sand infill 82 from the weather. Thus, in an application wherein the grass blade ends 92 are preferably about 2.0 inches (about 5.0 cm) high, the infill layer 82 is preferably about 1.75 inches (about 4.44 cm) high, leaving a distance I of preferably about 0.25 inch (about 0.63 cm).

To look like grass, the polyethylene yarn is pigmented green. While synthetic turf has made use of a green pigment, other applications of polyethylene employ different colors.

FIG. 2 further illustrates one stitch row for the turf system 10B. Every single, 2nd, 4th, 8th, 16th or 32nd stitch row (or any row in-between these rows or about the 32nd row) may contain an antistat filament 33 as shown with parallel black line shading. The thickness of the antistat filament 33 has been exaggerated in order to show its placement within each tuft that forms a set of two bundles 29 of grass blade ends 92. Generally, the antistat filament 33 may have the same thickness or less thickness relative to the other monofilaments forming each yarn 90 that is tufted.

In the exemplary embodiment of FIG. 2, one end of the antistat filament 33 is shown being combined with a plurality of monofilaments (typically about 4 to about 12) to form a single tuft. Two bundles 29 of grass blade ends 92 are formed by one tuft of yarn 90. Approximately, one antistat filament 33 will be in one yarn 90 that is tufted or every two grass blade bundles 29. Like FIG. 1, in FIG. 2, each yarn 90 that is tufted is shown with two ends having an antistat filament 33. One of ordinary skill in the art recognizes that these two antistat filaments 33 illustrated for each yarn 90 is the same, single antistat filament 33. That is, only one antistat filament 33 is used in each yarn 90 that is tufted that is illustrated in FIG. 2. The single antistat filament 33 was not shown present along the entire length of yarn 90 that is tufted for brevity.

The turf system 10B, such as about a twelve or about fifteen feet (about 3.6 or about 4.5 m) roll of the preferred flexible turf 80, includes a fabric backing 86 preferably of double woven polypropylene and a flexible coating 88, which is preferably polyurethane. The thickness of the fabric backing 86 is preferably provided by the manufacturer. The thickness of the flexible coating 88 is preferably between about 10 and about 20 mils.

The preferred turf 80 includes a plurality of yarns 90, which are tufted or stitched into the primary backing 86. According to this exemplary embodiment of FIG. 2, the yarns 90 are not twisted like those as illustrated in FIG. 1.

The secondary backing 88, applied after tufting or stitching, covers some or all of the stitch depending on the thickness of the secondary backing 88. The preferred turf includes about 19 tufts or stitches per about every 3.75 inches (about 7.5 cm).

The yarns 90 are preferably polyethylene, between about 3500 and about 11000 denier, and about 40 to about 72 ounces per square yard. In other exemplary embodiments, the height of the grass blade ends 92, having a dimension k, above the bottom of the secondary backing 88 preferably is between about 0.50 inch to about 6.00 inches (about 1.25 to about 15.00 cm), and specifically about 1.00 to about 2.50 inches (about 2.54 to about 6.25 cm) and most preferably about 2.00 inches (about 5.0 cm).

In other exemplary embodiments, the height of the grass-like strands with ends 92, having a dimension l, relative to the infill layer 82 preferably is between about 0.25 inch to about 4.00 inches (about 0.60 to about 10.20 cm), and most preferably between about 0.50 inch to about 2.00 inches (about 1.30 to about 5.10 cm).

Figure 3:
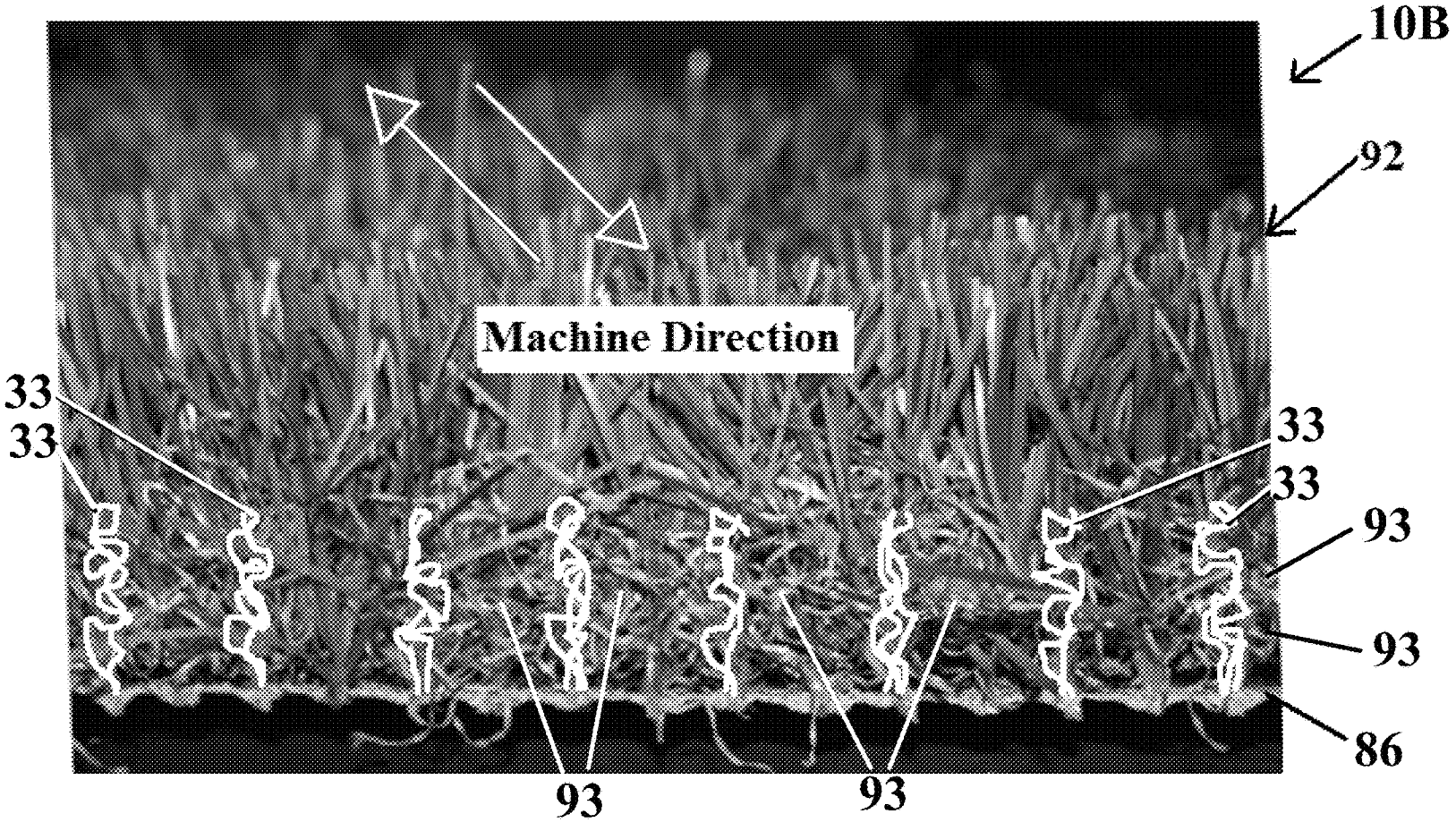
FIG. 3 illustrates a turf system with a black and white digital photograph of another exemplary embodiment having a second set of crimped, thatch-like fiber yarn which may be smaller than the grass-like fiber yarn of the prior exemplary embodiments and that may be combined with the grass-like fiber yarn.

Referring now to FIG. 3, this figure is a computer enhanced black and white digital photograph which illustrates a turf system 10B having a second set of crimped, thatch-like fiber yarn 93, which may be smaller than the grass blade ends 92 of the prior exemplary embodiments. This thatch-like fiber yarn 93 may be combined with the grass blade ends 92.

The crimped thatch-like fiber yarn 93 after incorporation into the turf system 10B will retract considerably so as to be below the surface of the vertically oriented grass blade ends 92. The grass-like fiber yarn with grass blade ends 92 may be monofilament fibers. Strands of yarn forming the thatch-like fiber yarn 93 may comprise from about 3.0 to about 50.0 or more individual filaments. The thatch-like fiber yarn 93 may be combined with an antistat filament 33 as will be described in detail below.

In FIG. 3, one antistat filament 33 may be present in every other stitch row of the turf system 10B that has a thatch make-up from thatch-like fiber yarn 93 (which are not grass blade ends 92 alone as illustrated in FIGS. 1 and 2). The antistat filament 33 of the thatch turf system 10B is presented with without any shading in this black and white digital photograph. Because the antistat filament 33 has been mechanically textured, the antistat filament 33 is separated into individual filaments and combined with the thatch-like fiber yarn 93.

The antistat filament 33 may also be added every single row, or every 2nd, 4th, 8th 16th, or 32nd row (or any row in-between these rows or about the 32nd row) as will be described below. It is further noted that some lead lines for some reference characters, like reference characters 33 and 93 of this figure have been depicted without any shading so that they are more readily visible in the black and white digital photograph illustrating one exemplary embodiment of the turf system 10B.

Figures 4A, 4B:
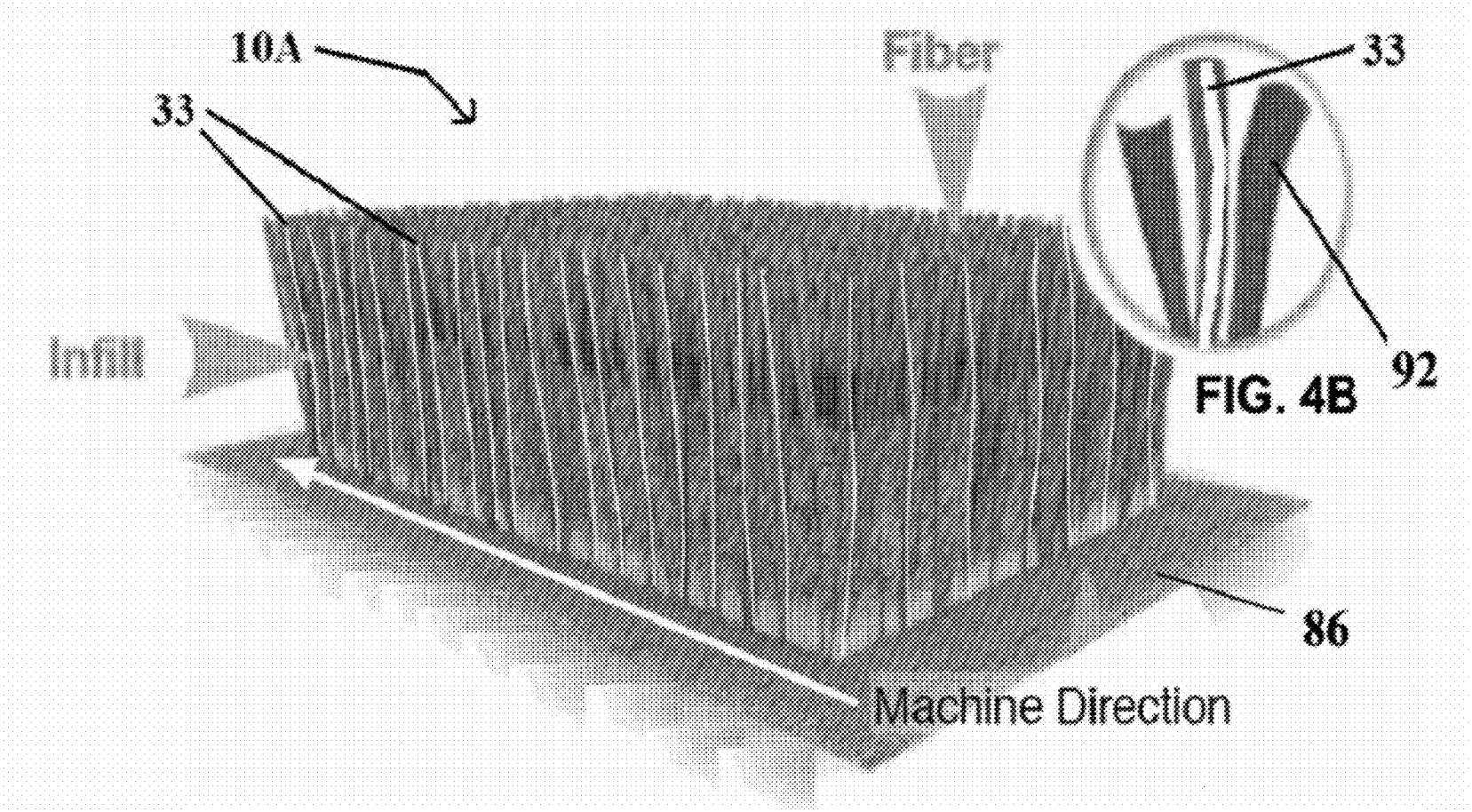
FIGS. 4A and 4B illustrate a perspective view and a close-up view, respectively, of a single antistat filament placed in every stitch row in an exemplary turf system corresponding to FIG. 1.

FIGS. 4A and 4B illustrate a perspective view and a close-up view, respectively, of a single antistat filament 33 placed in every stitch row in an exemplary turf system 10A corresponding to FIG. 1. The antistat filament 33 is not presented with any shading to set it apart from the ends 92 of the yarn 90.

Figure 5:
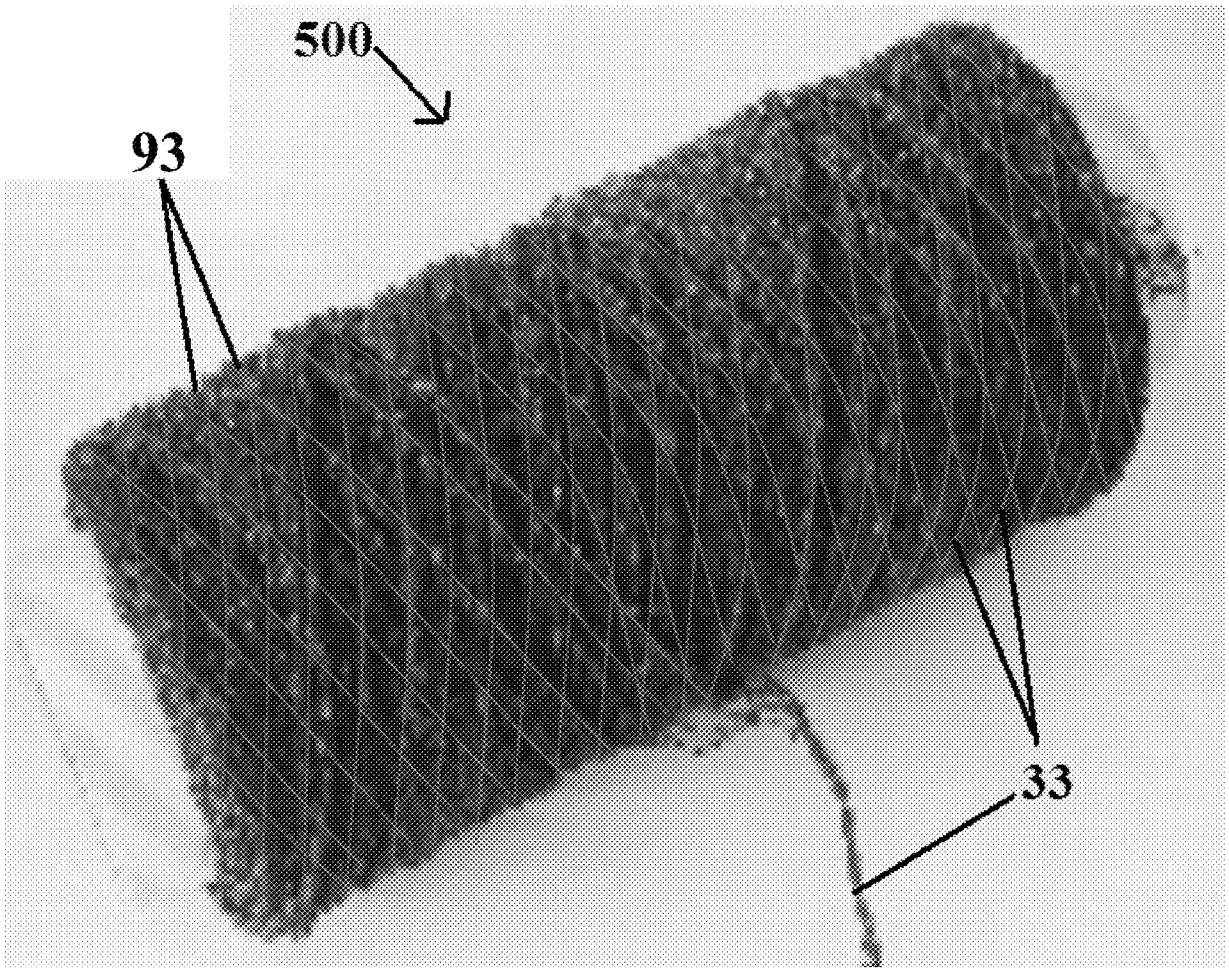
FIG. 5 illustrates a package (tube) of textured yarn that is used to make the turf thatch exemplary embodiment of FIGS. 4A-4B.

FIG. 5 illustrates a package (tube) 500 of textured yarn that is used to make the thatch-like fiber yarn 93 exemplary embodiment of FIGS. 4A-4B. One end of an antistat filament 33 is added to the textured yarn of tube 500 in the texturizing process. The antistat filament 33 is illustrated with the absence of color for clarity purposes. At this stage, the antistat filament 33 will be tangled and separated into antistat filaments 33 as illustrated in FIGS. 4A-4B.

The antistat filament 33 may be entangled with a grass yarn bundle (not illustrated). In that case, the antistat filament 33 usually would NOT be tangled and separated in to individual filaments.

Figure 6:
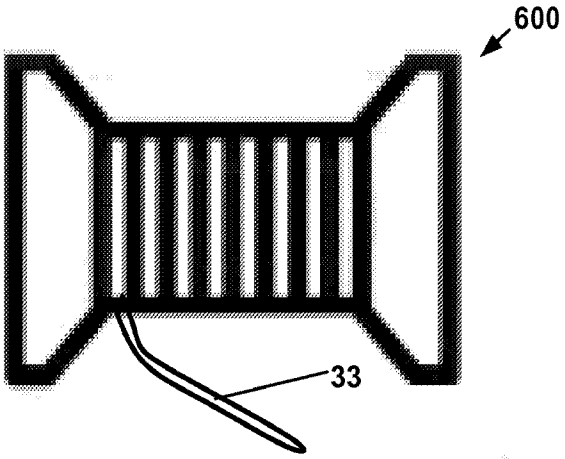
FIG. 6, illustrates an exemplary package of antistatic yarn according to one exemplary embodiment.

Referring now to FIG. 6, a package 600 of antistat filament 33 is illustrated. The package 600 may comprise Negastat™ brand of 140 denier antistat filament 33. Negastat™ brand of antistat filament 33 is sold by W. Barnet & Son LLC, of Arcadia, S.C. The antistat filament 33 may comprise a plurality of sheath core carbon/polyester multi-filament fibers. The antistat filament 33 may comprise about 24.0 filaments.

The antistat filament 33 may comprise a filament, bi-component yarn having a conductive core, such as carbon, surrounded by a sheath of nonconducting material, like polyester. The linear mass density or denier of the antistat filament 33 may comprise at least one of 35d-f6, 70d-f12, and 140d-f24.

Figure 7:
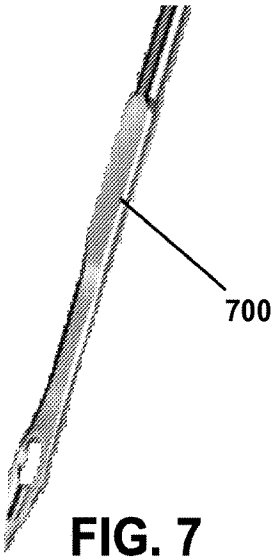
FIG. 7 illustrates a tufting needle according to one exemplary embodiment.

The antistat filament 33 may be added to the yarn 90 at twisting or texturing. A bundle of grass monofilament fibers (typically about 4 to about 12 filaments of nylon, polyethylene, polypropylene or polyester) are usually twisted less than about 1 turn per inch (tpi) in order to create a bundle 29 that will more easily feed through a tufting needle 700 (as illustrated in FIG. 7).

The antistat filament 33 may be added to a bundle 29 of grass fibers at the point of twisting. Alternatively, the antistat filament 33 may be added to a bundle 29 of thatch fibers (typically about 4 to about 12 filaments of nylon, polyethylene, polypropylene or polyester) that may be textured using an air jet, stuffer box or some other means to impart crimp and fiber entanglement.

The yarns 90 may be textured to provide a thatch aesthetic and to cause the fiber to draw down below the surface of the grass monofilament fibers. The antistat filament 33 may also be added to a companion yarn 90 such as a polyester yarn of a similar denier by twisting the two yarns together. This process provides additional strength to the antistat filament 33 so that it can be more easily added into synthetic grass fiber or into synthetic thatch fiber without breaking.

This is done since off-the-shelf antistat filaments 33 are usually relatively weak fibers, such as having about 3.3 gms/denier. Usually, the antistat filaments 33 should have a strength of at least about 2.7 gms/denier. In other exemplary embodiments, antistat filaments 33 having at least 3.5 gms/denier have been found to yield favorable results.

Figure 8:
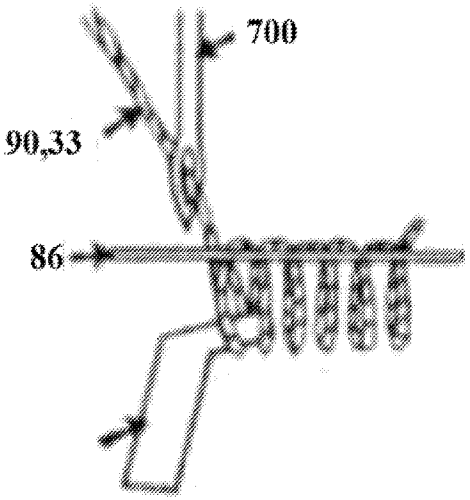
FIG. 8 illustrates a tufting process that includes a tufting needle used to push the yarn bundle having the antistatic yarn and a companion yarn through a backing material.

FIG. 8 illustrates a tufting process 800 that includes a tufting needle 700 used to push the yarn bundle having the antistat filament 33 and companion yarn 90 through a backing 86.

Figures 9A, 9B, 9C, 9D, 9E:
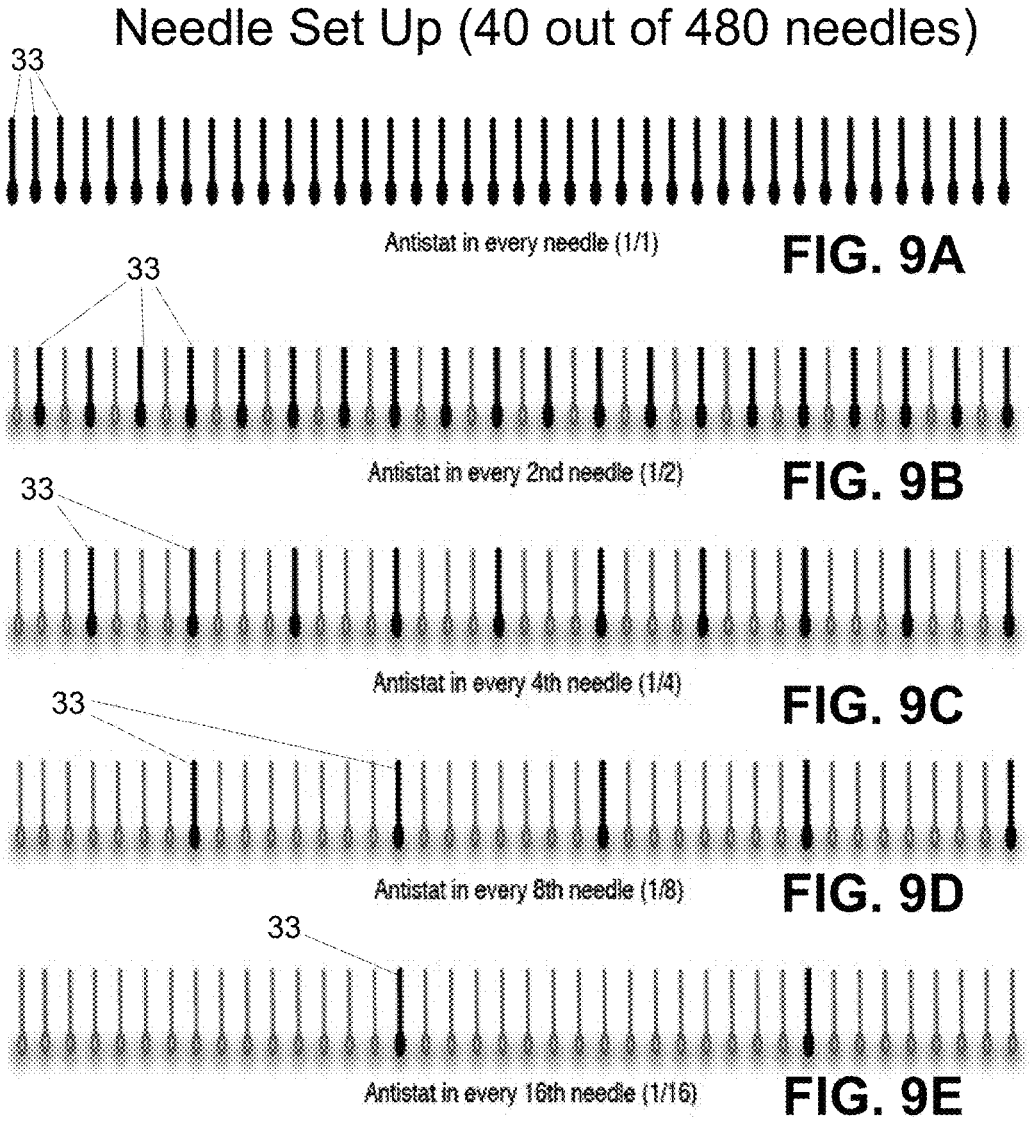
FIG. 9A illustrates exemplary needle set ups for a tufting machine that include an antistatic fiber in every needle (1/1)
FIG. 9B illustrates an antistatic fiber in every second needle (1/2) according to one exemplary embodiment.
FIG. 9C illustrates an antistatic fiber in every fourth needle (1/4) according to one exemplary embodiment.
FIG. 9D illustrates an antistatic fiber in every eighth needle (1/8) according to one exemplary embodiment.
FIG. 9E illustrates an antistatic fiber in every sixteenth needle (1/16) according to one exemplary embodiment.

FIG. 9A illustrates exemplary needle set ups for a tufting machine (not shown) that include an antistat filament 33 in every needle (1/1). Such a needle set up in FIG. 9A will yield at least one antistat filament 33 per yarn 90 that is tufted. FIG. 9B illustrates an antistat filament 33 in every second needle (1/2) for another exemplary needle set up. Such a needle set up in FIG. 9B will yield where about 16 in about 32 tuft rows comprise at least one antistat filament 33 per yarn 90 that is tufted.

FIG. 9C illustrates an antistat filament 33 in every fourth needle (1/4) while FIG. 9D illustrates an antistat filament 33 in every eighth needle (1/8) for another exemplary needle set up. Such a needle set up in FIG. 9C will yield where about 8 in about 32 tuft rows comprise at least one antistat filament 33 per yarn 90 that is tufted. Such a needle set up in FIG. 9D will yield where about 4 in about 32 tuft rows comprise at least one antistat filament 33 per yarn 90 that is tufted.

FIG. 9E illustrates an antistat filament 33 in every sixteenth needle (1/16) for another exemplary needle set up. Such a needle set up in FIG. 9E will yield where about 2 in about 32 tuft rows comprise at least one antistat filament 33 per yarn 90. At a minimum, turf 10 tufted from monofilament fibers of a thermoplastic polymer will usually have about 1 in about 32 tuft rows that comprise at least one antistat filament 33 per yarn 90, where each antistat filament 33 has a nonconductive polymeric component coextensive with a component of carbon dispersed in a polymeric matrix.

Figure 10:
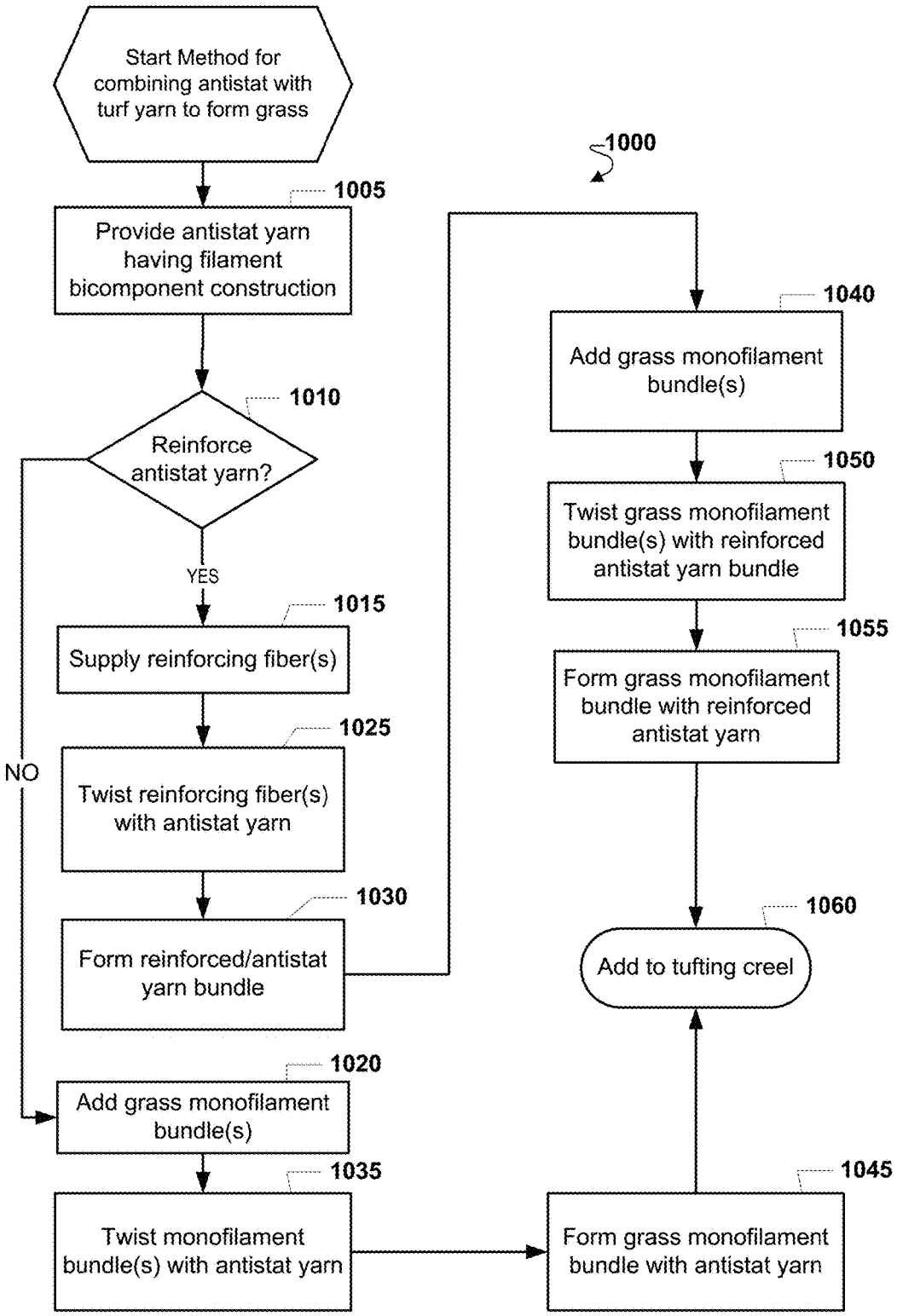
FIG. 10 illustrates a flow chart of exemplary steps for an antistatic yarn/grass yarn combining process for forming grass.

FIG. 10 illustrates a flowchart for a method 1000 for combining an antistat filament with turf yarn to form grass according to an exemplary embodiment of the invention. Block 1005 is the first step of method 1000.

In block 1005, an antistat filament 33 may be provided or supplied. As described previously, the antistat filament 33 may comprise a filament bi-component yarn having a conducting core, such as carbon, surrounded by a sheath of nonconducting material, such as polyester. The linear mass density or denier of the antistat filament 33 may comprise at least one of 35d-f6, 70d-f12, and 140d-f24. As of this writing, one brand of antistat filament 33 is sold under the brand name NEGASTAT™ sold by W. Barnet & Son LLC of Arcadia, S.C.

Next, in decision block 1010, it is determined whether the antistat filament 33 needs to be reinforced in order to increase its strength for a particular grass application. If the inquiry to decision block 1010 is positive, then the "YES" branch is followed to block 1015. If the inquiry to decision block 1010 is negative, then the "NO" branch is followed to block 1020.

In block 1015, a reinforcing fiber, such as 150 denier polyester, may be supplied. However, other types of reinforcing fibers such as nylon, polypropylene, cellulose acetate, polyethylene, or polyethylene terephthalate (PET), may be used.

Next, in block 1025, the antistat filament 33 and the reinforcing fiber supplied in block 1015 are twisted together. Next, in block 1030, as a result of the twisting of block 1025, a reinforced yarn 90 is formed.

Subsequently, in block 1040, monofilament grass bundles that have between about 4 and about 12 fibers may be supplied. In block 1050, the monofilament grass bundles may be twisted together with the antistat filament 33/PET combination produced from block 1030. After the twisting operation in block 1050, a grass monofilament bundle with 1 PET/antistat filament 33 has been formed and may be supplied to a tufting creel in block 1060.

Returning back to the negative output to decision block 1010, in which reinforcement of the antistat filament 33 is not desired, in block 1020, like block 1040, monofilament grass bundles that have between about 4 and about 12 fibers may be supplied. Next in block 1035, the antistat filament 33 and the monofilament grass bundles are twisted together like block 1050. As a result, in block 1045 a grass monofilament bundle having antistat filament 33 is formed and may be supplied to a tufting creel in block 1060.

Figure 11:
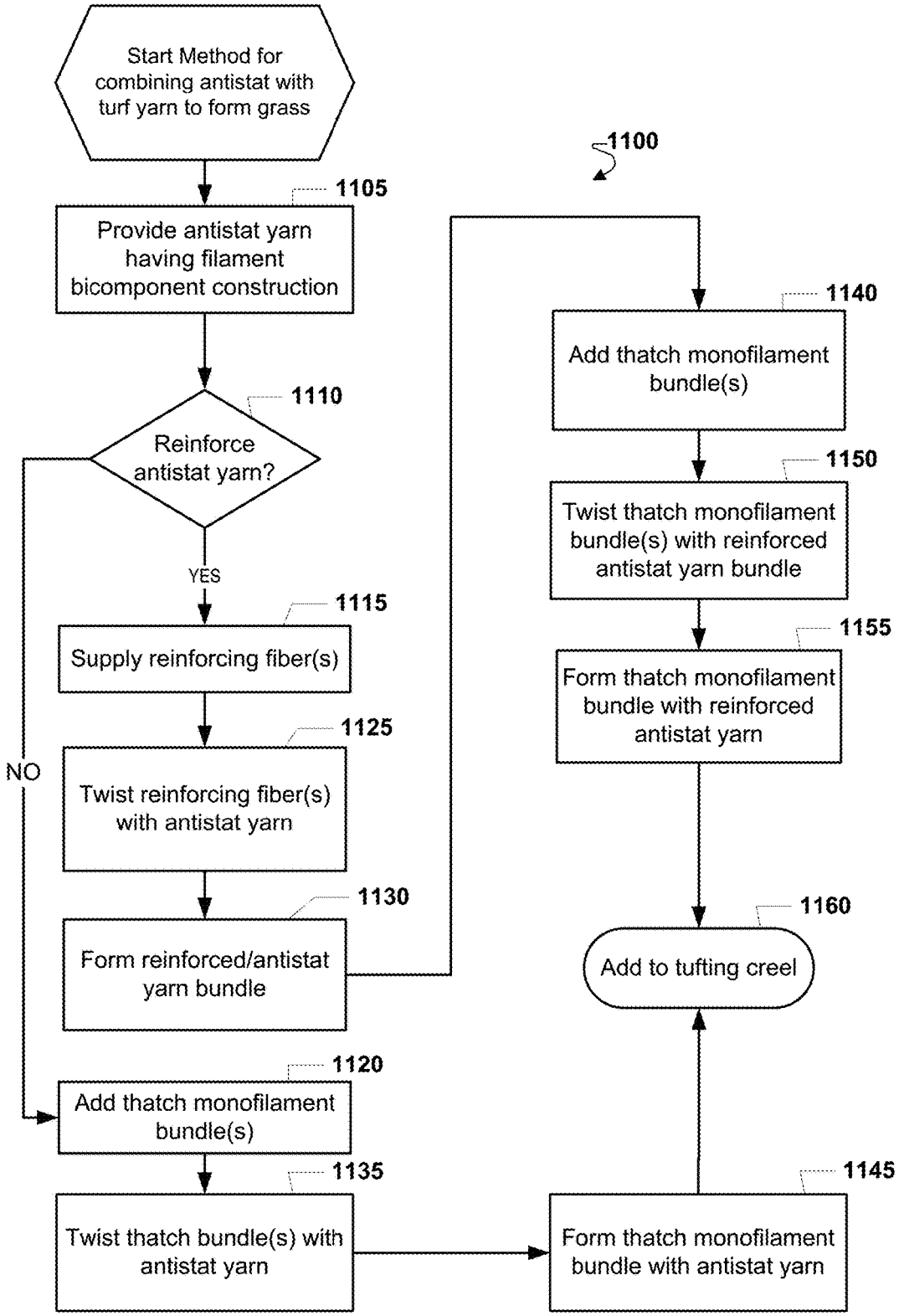
FIG. 11 illustrates a flow chart of exemplary steps for an antistatic yarn/thatch yarn combining process for forming thatch.

FIG. 11 illustrates a flowchart for another method 1100 for combining an antistat filament with turf yarn to form grass according to an exemplary embodiment of the invention. Block 1105 is the first step of method 1100.

In block 1105, an antistat filament 33 may be provided or supplied. As described previously, the antistat filament 33 may comprise a filament bi-component yarn having a conducting core surrounded by a sheath of nonconducting material, such as polyester. The linear mass density or denier of the antistat filament may comprise at least one of 35d-f6, 70d-f12, and 140d-f24. As of this writing, one brand of antistat filament 33 is sold under the brand name NEGASTAT™ sold by W. Barnet & Son LLC of Arcadia, S.C.

Next, in decision block 1110, it is determined whether the antistat filament 33 needs to be reinforced in order to increase its strength for a particular grass application. If the inquiry to decision block 1110 is positive, then the "YES"

branch is followed to block 1115. If the inquiry to decision block 1110 is negative, then the "NO" branch is followed to block 1120.

In block 1115, a reinforcing fiber, such as 150 denier polyester, may be supplied. However, other types of reinforcing fibers such as nylon, polypropylene, cellulose acetate, polyethylene, or polyethylene terephthalate (PET) may be used.

Next, in block 1125, the antistat filament 33 and the reinforcing fiber supplied in block 1115 are twisted together. Next, in block 1130, for as a result of the twisting of block 1025, a reinforced yarn 90 is formed.

Subsequently, in block 1140, monofilament thatch bundles that have between about 4 and about 12 fibers may be supplied. In block 1150, the monofilament thatch bundles may be air entangled and/or mechanically crimped with the antistat filament 33/PET combination produced from block 1130. After the entangle/crimping operation in block 1150, a thatch monofilament bundle with 1 PET/antistat filament 33 has been formed and may be supplied to a tufting creel in block 1160.

Returning back to the negative output to decision block 1110, in which reinforcement of the antistat filament 33 is not desired, in block 1120, like block 1140, thatch grass bundles that have between about 4 and about 12 fibers may be supplied. Next in block 1135, the antistat filament 33 and the thatch grass bundles are air entangled and/or mechanically crimped together like block 1150. As a result, in block 1145, a thatch monofilament bundle having antistat filament 33 is formed and may be supplied to a tufting creel in block 1160.

Figure 12:
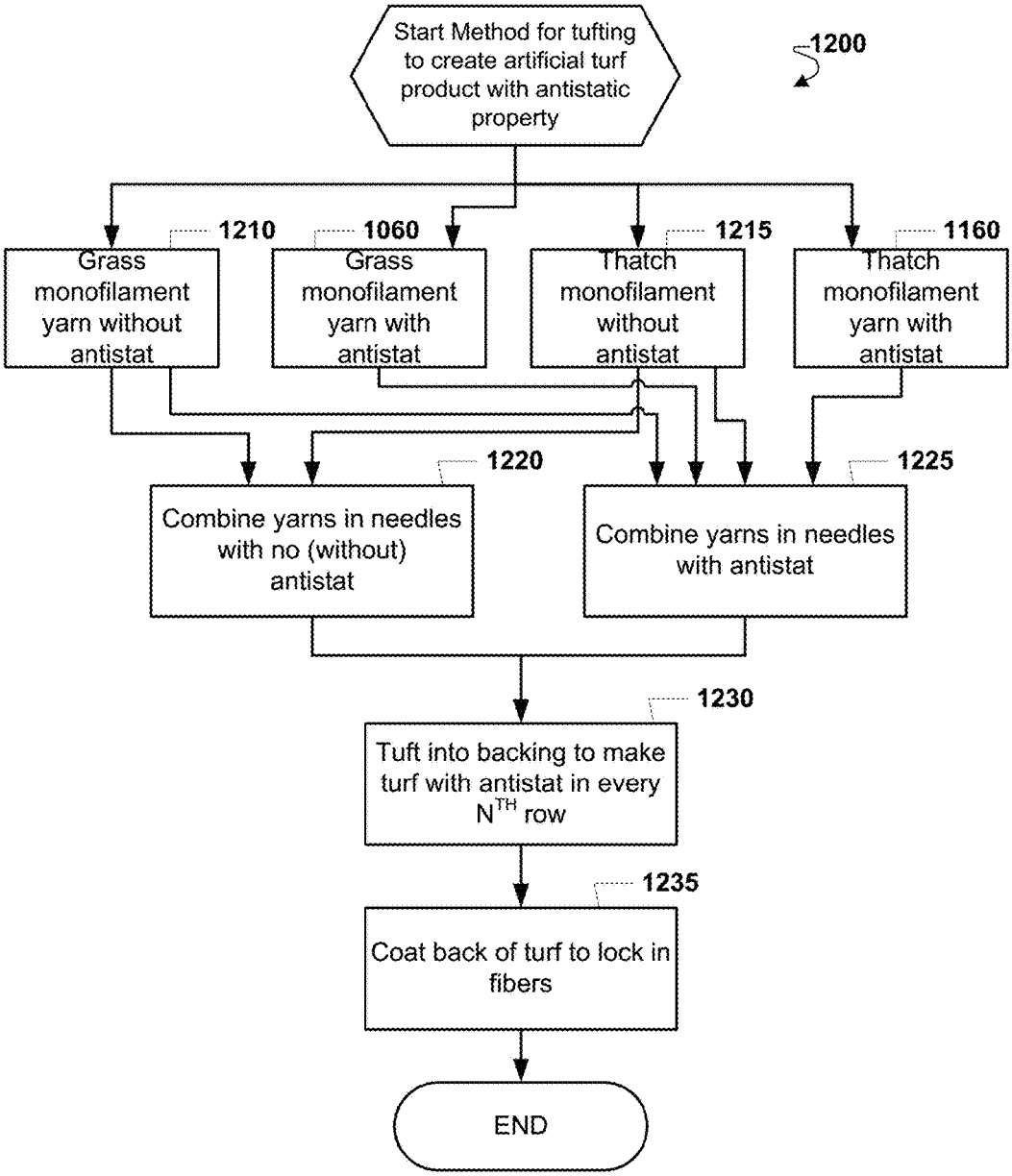
FIG. 12 illustrates a flow chart of exemplary steps for a tufting process for a turf system.

FIG. 12 illustrates a flowchart for a method 1200 for tufting to form the turf systems 10 of FIGS. 1-4 illustrated above according to an exemplary embodiment of the invention. Block 1205 is the first step of method 1200.

In block 1205, the yarn used to create the turf systems 10 are hung in a creel. Specifically, depending upon the type of turf system 10 desired, such as the grass system 10A or thatch system 10B, then block 1205 may correspond with block 1060 and or 1160 of FIGS. 11-12.

In block 1210, a grass monofilament yarn having about 4 to about 12 fibers per bundle without (in absence of) any antistat filament 33 may be supplied. Alternatively, in block 1060, a grass monofilament yarn that has been combined with an antistat filament 33 having about 4 to about 12 fibers per bundle in addition to an antistat filament 33 may be supplied. This block 1060 corresponds to block 1060 of FIG. 10.

Alternatively, in block 1215 a thatch monofilament yarn having about 4 to about 12 fibers per bundle without (absence of) any antistat filament 33. Or alternatively, in block 1160 a thatch monofilament yarn having an antistat filament 33 with about 4 to about 12 thatch yarns in addition to an antistat filament 33 may be supplied on the creel. Block 1160 corresponds to block 1160 of FIG. 11.

Next, in block 1220, the yarns supplied on the creels and blocks 1210 or 1215 may be combined in needles such as illustrated in FIG. 8 and without any antistat filament 33 at about 480 needles for about three-eighths inch gauge at about fifteen feet width.

Alternatively, or in parallel to block 1220, in block 1225, the yarns supplied on the creels of block 1210, 1060, 1215, or 1160 may be combined in needles with an antistat filament 33 at 480, 240, 120, 60, or 30 needles for about three-eighths inch gauge at about fifteen feet width.

Next, in block 1230, the yarns may be tufted into a backing 86 such as illustrated in FIG. 8 with an antistat filament 33 in every first, second, fourth, eighth, or sixteenth stitch row as illustrated in FIGS. 9A-9E. Next, in block 1235 the backing 86 may be coated with a coating 88 such as illustrated in FIG. 2 in order to lock in the fibers into the turf system 10. The method 1200 then ends.

Testing of Turf System 10

It has been discovered that conventional approaches for reducing or eliminating static issues such as used for carpet will not work. Notably, laboratory testing confirms such as Test Method 134-2006 Electrostatic Propensity of Carpets Developed in 1969 by American Association of Textile Chemists and Colorists (AATCC) Committee RA32 conducted on turf with incorporated antistat filament 33 shows no benefit versus testing of synthetic turf that has no antistat filament 33. Other testing such as the AATCC 13-2006 after the turf 10 has been carefully washed to remove topical surfactants applied during the manufacturing process shows similar results.

Exemplary Test Results are provided in Appendix A—Test Data. The results provided in Appendix A were greater than those which would have been expected from the prior art to an unobvious extent, and these results are of a significant, practical advantage, as described above and below. The evidence of the test data section listed below establishes that the differences in results are in fact unexpected and unobvious and have both statistical and practical significance.

It has been discovered that surprisingly and unexpectedly when antistat filament 33, such as between about 50.0 to about 200.0 denier, and in some exemplary embodiments of about 140.0 denier, and the antistat filament 33, comprising a sheath of polyester and a core of carbon, is loosely twisted with nylon, polyethylene, polypropylene, or polyester monofilament fibers and tufted into synthetic turf 10 where about 1 in about 32 tuft rows comprise at least one antistat filament 33 per tuft (as well as turf 10 having antistat filament 33: tuft ratios of 1:2/1:4/1:8/and 1:16 as set forth in the test data section listed below), such turf 10 significantly and unexpectedly eliminates all static shock developed on a control side which does not have any antistat filaments-33.

This difference is manifested on turf 10 that is tufted such that about ½ of the width of the turf contains antistat filament 33 and the remaining about ½ of the width of the turf contains no antistat filament 33. When the turf 10 is placed outdoors in a use environment there is initially no static (or substantially nominal) charge build up on the test or control areas (which do not have any antistat filament 33).

Over time and exposure to the outdoor environment static can be generated on the control or untreated area by scuffing normal athletic shoes over the surface of the conventional side of the turf. A similar static build up is not realized on the treated turf system 10 having any one of the antistat filament/tuft ratios (B-F listed in the test data section listed below).

Surprisingly and unexpectedly, once a static charge is generated on the control side and the test subject walks from the control side to the test side, the static charge does not transfer. In fact, no static shock is realized once the subject touches a metal pole while standing on the test side of the inventive turf system 10 having the antistat filament: tuft row ratios (B-F) listed in the test data section listed below. One of ordinary skill in the art would expect that the inventive turf system 10 with one of the ratios (B-F) may substantially reduce some static discharge. However, the turf system 10 having any one of five antistat filament: tuft row ratios (B-F) substantially eliminates all static discharge developed on the control (conventional) side of the test turf 10.

Certain steps in the processes or process flows described in this specification naturally precede others for the invention to function as described. However, the invention is not limited to the order of the steps described if such order or sequence does not alter the functionality of the invention. That is, it is recognized that some steps may performed before, after, or parallel (substantially simultaneously with) other steps without departing from the scope and spirit of the disclosure. In some instances, certain steps may be omitted or not performed without departing from the invention. Further, words such as "thereafter", "then", "next", etc. are not intended to limit the order of the steps. These words are simply used to guide the reader through the description of the sample methods described herein.

Although only a few embodiments have been described in detail above, those skilled in the art will readily appreciate that many modifications are possible in the embodiments without materially departing from this invention. Accordingly, all such modifications are intended to be included within the scope of this disclosure as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, sixth paragraph for any limitations of any of the claims herein, except for those in which the claim expressly uses the words 'means for' together with an associated function.

Test Data Section

A turf was constructed on Jan. 4, 2011 such the width of the turf contained the following test constructions:

A—No antistat filament

B—1 out of every 2 stitch rows contained 1 antistat filament

C—1 out of every 4 stitch rows contained 1 antistat filament

D—1 out of every 8 stitch rows contained 1 antistat filament

E—1 out of every 16 stitch rows contained 1 antistat filament

F—1 out of every 32 stitch rows contained 1 antistat filament

Boundaries between the samples A-F were carefully marked.

Then among the dates of Jan. 17, 2001 (test I), Jan. 19, 2011 (test II), and Feb. 24, 2011 (test III):

The single piece of turf containing the six test constructions (A-F) was placed outdoors and a test subject, wearing sneakers made with an elastomeric sole, walked across each sample in a lengthwise direction so as not to contact adjacent samples. After the subject walked across the turf in a careful and controlled manner for 30 seconds a grounded metal pole was touched to discharge any static charge that has developed. Humans can typically sense a static charge of 2 kV and above.

In the first test (I), the turf tested immediately after laying it on the ground. The results are summarized in Table 1.

In the second test (II), the turf was thoroughly washed so as to remove any oils or surfactants that may be present from the manufacturing process. The results of this test are summarized in Table 1.

In the third test (III), the turf was left outdoors, exposed to the elements for 2 months. The results of this test are summarized in Table 1.

The test was repeated and the results were confirmed.

TABLE 1

TEST DATA

| Antistat filament Content | Test I Immediately After Installation | Test II After Rinsing with Water | Test III After 2 months of Exposure to the Elements |
|---|---|---|---|
| None (Conventional Art) | No Shock | No Shock | Shock |
| 1 antistat filament in 1 out of every 2 stitch rows | No Shock | No Shock | No Shock |
| 1 antistat filament in 1 out of every 4 stitch rows | No Shock | No Shock | No Shock |
| 1 antistat filament in 1 out of every 8 stitch rows | No Shock | No Shock | No Shock |
| 1 antistat filament in 1 out of every 16 stitch rows | No Shock | No Shock | No Shock |
| 1 antistat filament in 1 out of every 32 stitch rows | No Shock | No Shock | No Shock |

Hypothesis on why test I and test II did not yield any shock for the control section which did not have any antistat filament: The results of test I and II on control section (no-antistat filament) may be attributed to the presence of fiber lubricants which frequently include nonionic, and sometimes, ionic surfactants, both which can act as non-substantive antistat components. The entire turf (including both the anti-stat sections and the single non-antistat section) was rinsed after manufacture The purpose of the water rinse is to remove any surfactants that might be present from manufacturing. That there was no shock after the water rinse for the control section (having no anti-stat filament) is perplexing but is consistent with the laboratory testing that was also conducted. One possible, but weak, explanation is that the water rinse was insufficient to remove the surfactants. This may be the reason in the case of low HLB surfactants. Over time, with outdoor exposure, and after weathering, it is conceivable that these "difficult to remove" surfactants were removed completely.

What is claimed is:

1. A synthetic turf system comprising:

turf tufted from monofilament fibers of a thermoplastic polymer wherein the turf is tufted according to a ratio of one row of tufts comprising an antistatic filament per a number of tuft rows, each antistatic filament having a first nonconductive polymeric component coextensive with a component of a second conductive material comprising carbon, each antistatic filament comprising a core and a sheath surrounding the core, the sheath comprising the first nonconductive polymeric component and the core comprising the second conductive material, each antistatic filament having a denier between about 50.0 to about 200.0, one or more of the antistatic filaments substantially eliminates static electrical discharge within the turf when static electrical charge is generated within the synthetic turf;

wherein the thermoplastic polymer comprises at least one of nylon, polyethylene, polypropylene, and polyester;

wherein one or more monofilament fibers of the tufts are fibrillated or slit tape monofilament fibers;

wherein the ratio of the one row of tufts comprising an antistatic filament per number of tuft rows comprises at least one of 1:2, 1:4, 1:8, 1:16, and 1:32;

wherein the monofilament fibers of the thermoplastic polymer form synthetic grass blades; and an infill material positioned within the synthetic grass blades.

2. The system of claim 1, wherein the infill material comprises at least one of granulated cork; rubber particles including natural rubber or synthetic rubber; beads of synthetic polymers comprising at least one of vinyl chloride, vinyl ethers, vinyl acetate, acrylates, methacrylates, polyvinylidene chloride, urethanes, polyamids and polyesters; synthetic polymer foam particles; vinyl foams including polyvinyl chloride foams, polyvinyl ether foams, foamed polystyrene, foamed polyurethanes and foamed polyesters; foamed natural rubber; Ethylene Propylene Diene Monomer (EPDM); ground tire rubber; and Thermoplastic Elastomers (TPE).

3. The system of claim 1, wherein the turf is used for at least one of commercial and residential landscapes.

4. The system of claim 3, wherein the turf is used for a playground.

5. The system of claim 1, wherein the turf is used for an athletic field.

6. A synthetic turf system comprising:

turf tufted from monofilament fibers of a thermoplastic polymer where about 1 row of tufts comprising an antistatic filament in about 32 tuft rows comprise at least one antistatic filament per tuft, each antistatic filament having a nonconductive polymeric component coextensive with a component of carbon dispersed in a polymeric matrix, each antistatic filament comprising a core and a sheath surrounding the core, the sheath comprising the first nonconductive polymeric component and the core comprising the carbon, each antistatic filament having a denier between about 50.0 to about 200.0, one or more of the antistatic filaments substantially eliminates static electrical discharge within the turf when static charge is produced within the turf; wherein the thermoplastic polymer comprises at least one of nylon, polyethylene, polypropylene, and polyester; and wherein monofilament fibers of each tuft are fibrillated or slit tape monofilament fibers; wherein the monofilament fibers of the thermoplastic polymer form synthetic grass blades; and an infill material positioned within the synthetic grass blades.

7. The system of claim 6, wherein the turf is used for at least one of commercial and residential landscapes.

8. The system of claim 7, wherein the turf is used for a playground.

9. The system of claim 7, wherein the turf is used for an athletic field.

* * * * *